United States Patent [19]

Eilert et al.

[11] Patent Number: 5,008,974

[45] Date of Patent: Apr. 23, 1991

[54] CARRYING HANDLE ASSEMBLY

[75] Inventors: Randall N. Eilert, Lake Stevens; Robert M. Neel, Woodinville; N. Thatcher Harvey; Wilbur R. Ames, IV, both of Lake Stevens; Randall D. Lord, Everett, all of Wash.

[73] Assignee: Hewlett-Packard Company, Palo Alto, Calif.

[21] Appl. No.: 345,324

[22] Filed: Apr. 28, 1989

[51] Int. Cl.[5] ..... A47B 95/02

[52] U.S. Cl. ..... 16/114 R; 16/115

[58] Field of Search ..... 16/114 R, 115, 125; 403/406.1, 21; 411/372, 373, 374, 431

[56] References Cited

U.S. PATENT DOCUMENTS

| | | | |
|---|---|---|---|
| 1,425,534 | 8/1922 | Mosher | 16/114 R |
| 2,987,151 | 6/1961 | Frambes | 16/115 |
| 3,571,843 | 3/1971 | Szabo | 16/115 |
| 4,393,540 | 7/1983 | Yamamoto et al. | 16/114 R |
| 4,794,668 | 1/1989 | Lorence et al. | 16/114 R |
| 4,878,792 | 11/1989 | Frano | 411/372 |

FOREIGN PATENT DOCUMENTS

| | | | |
|---|---|---|---|
| 1058460 | 11/1953 | France | 411/373 |

*Primary Examiner*—Richard K. Seidel
*Assistant Examiner*—Carmine Cuda

[57] ABSTRACT

A one-piece removable carrying handle assembly (10) for removably attaching the handle assembly to an item to be carried. The carrying handle has a middle strap portion (18) with two end portions (14, 16). Each end portion (14, 16) includes a housing member (28, 24) that has a slot (44) adapted to receive attachment hardware. The attachment hardware includes a screw (30, 36) and a spacer (32, 38). A screw (30, 36) and a spacer (32, 38) fit through slots (22, 24) in the end portions (14, 16) of the assembly (10). Each housing (28) is designed to be positioned over a screw (30), spacer (32), and a slot (22) so that each end portion of the strap assembly (10) contains all separate parts and so that each end portion is lockingly attached to the middle strap portion to form a one-piece unit.

3 Claims, 1 Drawing Sheet

CARRYING HANDLE ASSEMBLY

BACKGROUND OF THE INVENTION

Carrying handles for heavy items which are designed to be removable are generally formed with a central strap portion and a group of attaching hardware for attaching both ends of the strap portion to the item to be carried. This group of attaching hardware usually includes a screw or the like in some sort of housing arrangement, the housing arrangement being provided to keep the screw or the like securely fastened to the strap portion and to the item to be carried. This involves loose small pieces to be set down and picked up during removal or insertion of the handle to the item to be carried so that a number of small pieces can easily be misplaced or lost. This type of carrying handle also presents the common problem of the strap being caught under the bushing during installation. It is also necessary that an installer learn the proper position and sequence of each individual part of the handle assembly for proper installation. The making of such handle assemblies is costly to the manufacturer and can be costly and inconvenient to the user who must replace lost parts or may have an improper installation.

SUMMARY OF THE INVENTION

In order to overcome problems inherent in the before described carrying handle assemblies, there has been provided by the present invention a new and novel carrying handle assembly which is a one piece strap member with installing hardware connected at both ends in a self-contained housing so that there are no loose pieces or problems with improper installation.

It is therefore an object and advantage of the present invention to provide a carrying handle assembly in an integrated one-piece unit with no loose parts that may become lost or misplaced.

Another object and advantage of the present invention is to provide a carrying handle assembly which is less costly to manufacture and more convenient and less costly to the user.

Yet another object and advantage of the present invention is to reduce the occurrence of the strap being caught under the bushing during installation.

Still another object and advantage of the present invention is to provide a carrying handle assembly that is quicker and less complicated to install.

These and other objects and advantages will become apparent from a review of the drawings and from a study of the specification portion hereinafter describing the preferred embodiment of the invention.

DESCRIPTION OF THE PREFERRED EMBODIMENT

Figure 1:
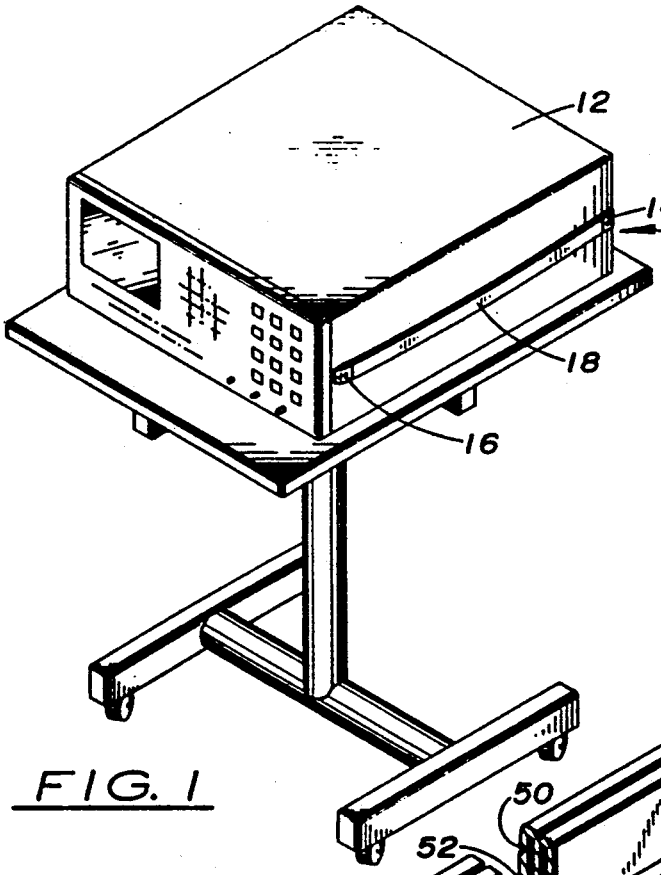
FIG. 1 is a perspective view of the present carrying handle assembly as it is shown attached on the side of an electronic instrument.

Referring now to the drawings in general, and in particular to FIG. 1 of the drawings, there is shown a perspective view of the present carrying handle assembly as it is used in the present example to carry an electronic instrument. Shown in FIG. 1 is the present carrying handle assembly shown generally by the numeral 10 as it would be attached to the side of an electronic instrument 12 and used to carry the electronic instrument. It can be seen in FIG. 1 that the carrying handle assembly 10 generally comprises two end portions 14 and 16 and a middle portion 18 as will be described with greater detail with reference to the remaining Figures.

Figure 2:
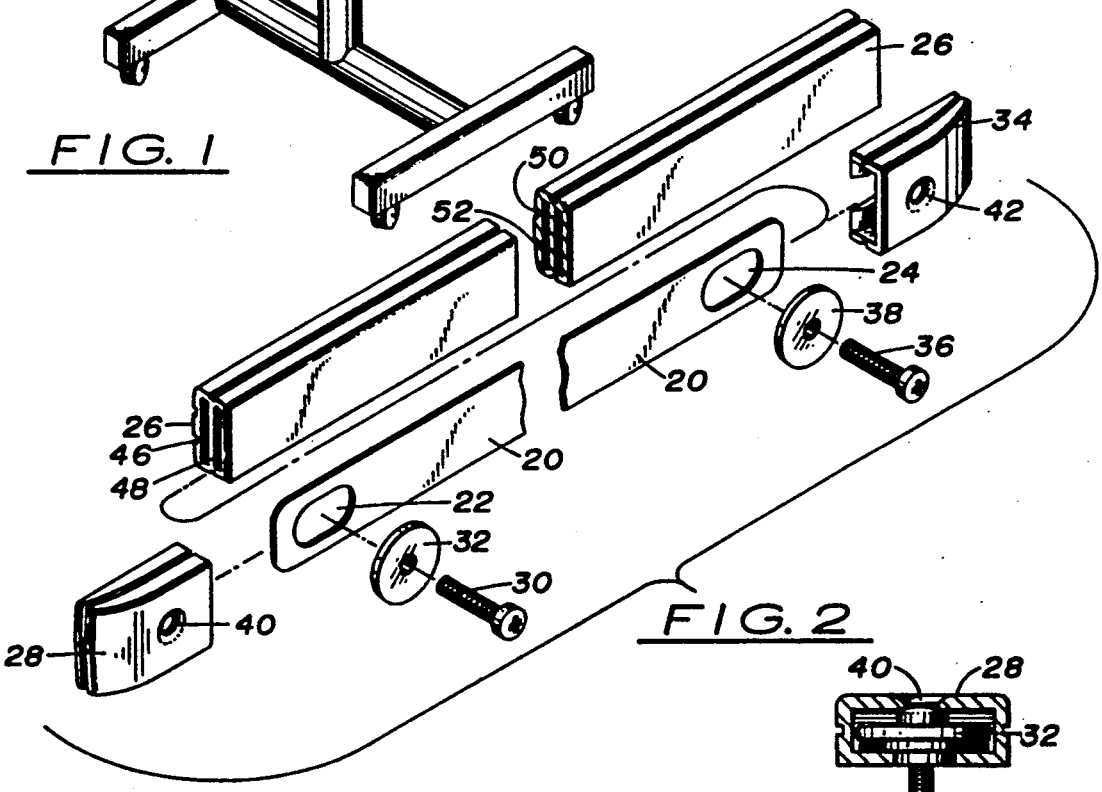
FIG. 2 is an exploded isometric view of the carrying handle assembly showing the composition of parts of the assembly.

Referring now to FIG. 2 of the drawings there is shown an exploded isometric view of the carrying handle assembly showing the composition of parts of the assembly. The middle portion 18 of the carrying handle assembly as shown in FIG. 1 includes an inner reinforcing strap 20, the inner reinforcing strap 20 having a slot 22, 24 positioned at each end thereof. When the carrying handle assembly 10 is assembled, the inner reinforcing strap 20 is positioned through the outer cover 26 and slots 22 and 24 remain outside the ends of the outer cover 26. There are two end portions 14, 16 for the present carrying handle assembly. On one end portion 16 of the carrying handle assembly 10 is a housing member 28, and an attachment means which includes a screw member 30, and a spacer member 32. On the opposite end portion 14 of the carrying handle assembly is a corresponding housing member 34, and attachment means including screw member 36, and spacer member 38. When the carrying handle assembly 10 is assembled, each screw member 30 and 36, and spacer members 32 and 38 are positioned through corresponding slots 22 and 24 and thus remain outside the end portions of the outer cover 26. In the preferred embodiment, the inner reinforcing strap 20 floats along the elongated slots 22 and 24 in the ends of the strap 20 thereby making the handle moveable. Each housing member 28 and 34 engages an associated attachment means as shown most clearly in FIGS. 3, 5, and 6. Each housing member thereby holds contained a number of loose parts such that it is required only that the user have a one-piece carrying handle assembly. The housing members 28 and 34 have corresponding holes 40 and 42 so that the screw members 30 and 36 may be accessed through the housing members 28 and 34 without removing the attachment means from the carrying handle assembly.

Figure 3:
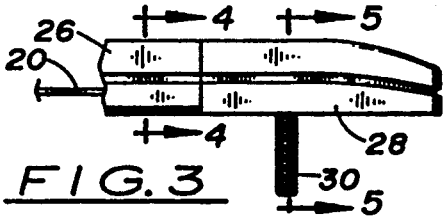
FIG. 3 is a partial side elevation view of the housing member for the attachment means of the present carrying handle assembly.

Referring now to FIG. 3 there is shown a partial side elevation view of the housing member 28 for the attachment means of the present carrying handle assembly. In FIG. 3 it can be seen that the housing member 28 has a corresponding screw 30 locked into a predetermined position and adapted to be screwed into a correspondingly threaded hole in an electronic instrument or other item to be carried. It can be seen further in FIG. 3 that the housing member 28 is adapted to be lockingly attached to the end of the outer cover 26. Also in FIG. 3, the attachment means in the form of the screw 30 and the spacer member 32, is contained within the housing member 28 with the threaded end of the screw member 30 being locked in a predetermined position so as to be easily attached to the item to be carried.

Figure 5:
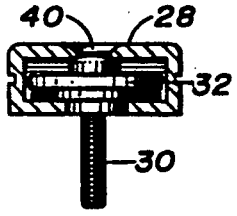
FIG. 5 is a cross-sectional view taken through line 5—5 of FIG. 3 showing the inside of a housing member and one of the attachment means of the present invention.

In FIG. 5 there is shown a cross-sectional view taken through line 5—5 of FIG. 3 showing the inside of the housing member 28 and one of the attachment means of the present invention. In FIG. 5 it can be seen that the housing member 28 contains a hole 40 for access to the screw member 30 through the top of the housing member. It should be noted that while there is access provided to screw member 30 the hole 40 is smaller than the head of the screw member 30 to prevent the screw member 30 from falling out of the top of the housing member 28. The spacer member 32 is positioned to secure screw member 30 into a predetermined position.

Figure 6:
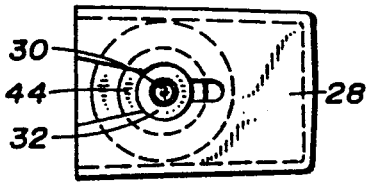
FIG. 6 is a bottom plan view of one of the attachment means of the carrying handle assembly showing how the attachment means fits into the housing member of the present invention.

FIG. 6 is a bottom plan view of housing member 28 and one of the attachment means of the carrying handle assembly showing how the attachment means fits into housing member 28 and the present invention. In FIG. 6 it can be seen that there is a receiving slot 44 adapted to receive the combination screw member 30 and spacer member 32, and the slot 44 is designed to lock the combination screw member 30 and spacer member 32 in a snap fit so that the screw member 30 and spacer member 32 will not fall out of the housing member 28.

Figure 4:
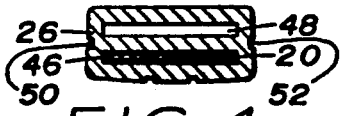
FIG. 4 is a cross-section view taken through line 4—4 of FIG. 3 showing the inside of the strap portion of the present carrying handle assembly.

In FIG. 4 of the drawings there is shown a cross-sectional view taken through line 4—4 of FIG. 3 showing the inside of the middle portion 18 of the present carrying handle assembly. In FIG. 4 it can be seen that the inner reinforcing strap 20 is positioned through a hole 46 in the outer cover 26. Positioned forward of the hole 46 is hole 48 which extends the length of the outer cover 26. The purpose of the hole 48 is to provide uniform thickness to the outer cover 26 and to the carrying handle assembly 10. The outer cover 26 has two grooves 50 and 52 which extend the length of the outer surface of the outer cover 26. The grooves 50 and 52 facilitate a non-slip grip of the carrying handle assembly. In the preferred embodiment of the present invention, the holes 40 and 42 in the housing members 28 and 34 each are recessed and adapted to hold the screw members 30 and 36 recessed within the housing members 28 and 34. The recessed holes 40 and 42 serve to allow access to the screw members while preventing the screw members from moving out of the top of the housing member. Also, in the preferred embodiment the attachment means is contained within a housing member which is approximately one and one-half inches in length and one inch in width with the middle portion 18 of the carrying handle assembly being the same width of approximately one inch and approximately nineteen inches long. Further in the preferred embodiment, the carrying handle assembly is made from plastic snap-fit parts to provide a secure locked-together assembly, and the inner reinforcing strap is stainless steel.

From the foregoing, it can be seen that applicants' invention provides a one-piece carrying handle assembly which contains the attachment hardware within the assembly thereby avoiding the loss of loose parts. The present carrying handle assembly also eliminates the necessity for detailed installation instruction and reduces the time and expense of manufacture and installation.

It should be apparent after studying the drawings and reading the description of the preferred embodiment that various changes may be made in the arrangement of the parts and the positioning of the various elements. The applicant is not to be limited to the exact embodiment which has been given by way of illustration only.

Having described our invention we claim:

1. A removable carrying handle comprising:

a strap having a slot formed through each end thereof;

an attachment means associated with each end of the strap, each attachment means comprising a headed fastener having a shaft;

a spacer member having a first part that retains the fastener head on one side of the strap, and a second part that protrudes through the slot to the other side of the strap, the spacer member being configured to engage the fastener with the fastener shaft extending through the slot; and a housing configured for locking engagement with the second part of the spacer member on said other side of the strap to secure the housing, spacer member and fastener to the strap.

2. The handle of claim 1 wherein the housing includes a hole formed therethrough concentric with the fastener shaft for exposing the head of the fastener.

3. The handle of claim 2 wherein the housing is configured so that the exposed head of the fastener does not fit through the hole in the housing.

* * * * *